US006883260B1

(12) United States Patent
Cobb et al.

(10) Patent No.: US 6,883,260 B1
(45) Date of Patent: Apr. 26, 2005

(54) FULL VIEW SIGN ASSEMBLY

(75) Inventors: Ron Cobb, Atlanta, GA (US); Ben Bell, Avondale, GA (US)

(73) Assignee: Apco Graphics, Inc., Atlanta, GA (US)

( * ) Notice: Subject to any disclaimer, the term of this patent is extended or adjusted under 35 U.S.C. 154(b) by 53 days.

(21) Appl. No.: 10/412,168

(22) Filed: Apr. 11, 2003

(51) Int. Cl.[7] ..... G09F 7/02

(52) U.S. Cl. ..... 40/611.08; 40/611.01; 40/611.03; 40/611.11

(58) Field of Search ..... 40/584, 611.01, 40/611.03, 611.04, 611.08, 611.1, 611.11, 619, 649, 661, 661.01

(56) References Cited

U.S. PATENT DOCUMENTS

| | | | |
|---|---|---|---|
| 1,895,938 | A | 1/1933 | Mutschler |
| 2,206,281 | A | 7/1940 | Goeller |
| 3,659,365 | A | 5/1972 | Eaton |
| 3,803,738 | A | 4/1974 | Weiss |
| 4,021,949 | A | 5/1977 | Niehaus et al. |
| 4,765,074 | A | 8/1988 | Loos |
| 4,831,754 | A | 5/1989 | Tallent |
| 5,065,537 | A | 11/1991 | Bailey |
| 5,174,056 | A | 12/1992 | King |
| 5,353,536 | A | 10/1994 | Erber et al. |
| 5,457,905 | A | 10/1995 | Kaplan |
| 5,781,980 | A | 7/1998 | Golston |
| 5,832,643 | A | 11/1998 | Delaquila et al. |
| 6,298,589 | B1 | 10/2001 | Hillstrom |
| 6,308,446 | B1 | 10/2001 | Healy |

*Primary Examiner*—Gary C. Hoge
(74) *Attorney, Agent, or Firm*—Chambliss, Bahner & Stophel, P.C.

(57) ABSTRACT

A sign assembly having a support surface including a first side frame portion, a second side frame portion and a back plate. The first and second side frame portions each include a longitudinal recess having a top and a bottom. The sign assembly also includes a third side frame portion, a fourth side frame portion, a front panel and a locking pin. The front panel includes a first side, a second side, a third side and a fourth side. The locking pin is adapted to be inserted into the second recess. The side frame portions, the front panel, and the locking pin are arranged so that when the second side of the front panel and the locking pin are in the second recess, the first side of the front panel will extend into the first recess; and when the locking pin is not in the second recess, the front panel may be moved so that its second side is toward the bottom of the second recess and its first side is out of the first recess so that the front panel may be pivoted about the second recess to remove the front panel from the sign frame.

20 Claims, 13 Drawing Sheets

FULL VIEW SIGN ASSEMBLY

FIELD OF THE INVENTION

This invention relates generally to sign assemblies having removable front panels. More particularly, the invention relates to an apparatus adapted to provide a substantially unobstructed, full view front panel which may be removed while the sign assembly is mounted to a wall or another structure.

BACKGROUND AND DESCRIPTION OF THE PRIOR ART

It is known to provide a sign assembly which includes a front panel that may be removed from the supporting frame of the assembly. Examples of such devices are described by U.S. Pat. No. 4,831,754 of Tallent, U.S. Pat. No. 5,781,980 of Golston, and U.S. Pat. No. 5,832,643 of Delaquila et al. Each of these devices, however, suffer from one or more disadvantages. For example, none of these devices provide a substantially unobstructed, full view front panel that may be removed and replaced while the sign assembly is mounted to a wall or another structure. More particularly, none of these devices includes a locking pin for removably securing the front panel to the frame of the assembly, which pin is inserted into the sign assembly from a location that is accessible while the device is mounted to a wall or other structure.

It would be desirable, therefore, if a sign assembly could be provided that would eliminate the need to remove the assembly from a mounted position on a wall or other structure in order to remove and replace the front panel. It would also be desirable if such an apparatus had a locking pin for the front panel that could be inserted into and removed from the sign assembly while the assembly is mounted to a wall or other structure. It would be further desirable if such an apparatus provided a substantially unobstructed, full view of the front panel of the sign assembly and any sign insert that is located behind the front panel.

ADVANTAGES OF THE INVENTION

Accordingly it is an advantage of the invention claimed herein to provide a sign assembly that need not be removed from a mounted position on a wall or other structure in order to remove and replace the front panel and any sign insert behind the front panel. It is also an advantage of the invention to provide an apparatus having a locking pin for the front panel that may be inserted into and removed from the sign assembly in order to permit removal of the front panel while the assembly is mounted on a wall or other structure. It is a further advantage of the invention to provide a sign assembly having a substantially unobstructed, full view of the front panel of the assembly and of any insert located behind the front panel.

Additional advantages of this invention will become apparent from an examination of the drawings and the ensuing description.

EXPLANATION OF TECHNICAL TERMS

As used herein, the term "generally rectangular" refers to the shape of a quadrilateral having at least one pair of substantially parallel sides.

SUMMARY OF THE INVENTION

The invention comprises a sign assembly comprising a support surface including a first side frame portion having a longitudinal first recess along the length thereof, a second side frame portion having a longitudinal second recess along the length thereof, and a back plate disposed between the first side frame portion and the second side frame portion. The first recess and the second recess each have a bottom and a top. The sign assembly also includes a third side frame portion and a fourth side frame portion. The third side frame portion is disposed generally opposite the fourth side frame portion.

The sign assembly also includes a front panel having a first side, a second side that is opposite the first side, a third side, and a fourth side that is opposite the third side. The distance between the first side and the second side is no greater than the distance between the bottom of the first recess and the top of the second recess. The distance between the third side and the fourth side is no greater than the distance between the third side frame portion and the fourth side frame portion. The sign assembly also includes a locking pin that is adapted to extend into and generally align with the second recess.

The first side frame portion, the second side frame portion, the third side frame portion, the fourth side frame portion, the front panel and the locking pin are arranged so that when the second side of the front panel is in the second recess and the locking pin is in the second recess, the first side of the front panel extends into the first recess. In addition, the first side frame portion, the second side frame portion, the third side frame portion, the fourth side frame portion, the front panel and the locking pin are arranged so that when the locking pin is not in the second recess, the front panel may be moved so that its second side is disposed toward the bottom of the second recess and its first side is disposed out of the first recess so that the front panel may be pivoted about the second recess to remove the front panel from the sign frame.

In a preferred embodiment of the present invention, the sign assembly includes a plurality of end caps adapted to be secured to the first and second side frame portions. At least one of the end caps includes a hole that is generally aligned with the second recess and adapted to receive the locking pin. In another preferred embodiment of the present invention, the four side frame portions are separate and a separate back plate is provided. In this preferred embodiment, the third or fourth side frame portion includes a hole that is generally aligned with the second recess and adapted to receive the locking pin. In further preferred embodiment of the present invention, the locking pin is made of a ferromagnetic material, and the hole through which the locking pin passes is chamfered.

In order to facilitate an understanding of the invention, the preferred embodiments are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
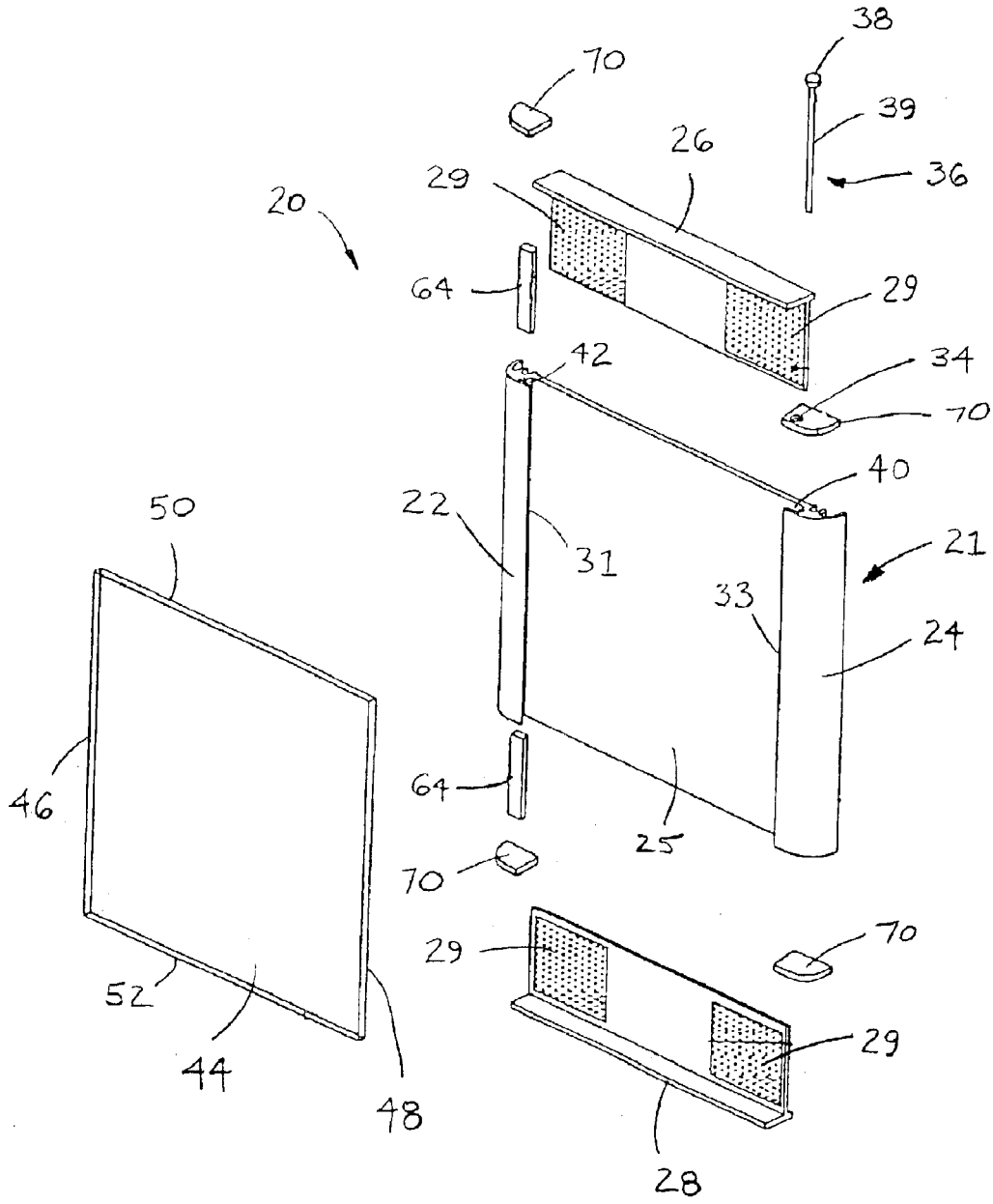
FIG. 1 is an exploded perspective view of a preferred embodiment of the sign assembly in accordance with the present invention.

Referring now to the drawings, FIGS. 1 through 13 illustrate various preferred embodiments of the sign assembly claimed herein. More particularly, FIG. 1 illustrates an exploded perspective view of a preferred embodiment of the sign assembly in accordance with the present invention As shown in FIG. 1, the preferred embodiment of the sign assembly is designated generally by reference numeral 20. Preferred sign assembly 20 includes support surface 21. Support surface 21 includes first side frame portion 22, second side frame portion 24 opposite the first side frame portion, and back plate 25 disposed between the first and second side frame portions. The first side frame portion and the second side frame portion each have a longitudinal recess along the length thereof as more fully discussed below. In a preferred embodiment, the first and second side frame portions are disposed generally parallel to each other. While support surface 21 is shown as being a single extrusion in FIG. 1, it is contemplated within the scope of the invention that the first and second side frame portions and the back plate may be separate elements as discussed more fully below.

Figure 2:
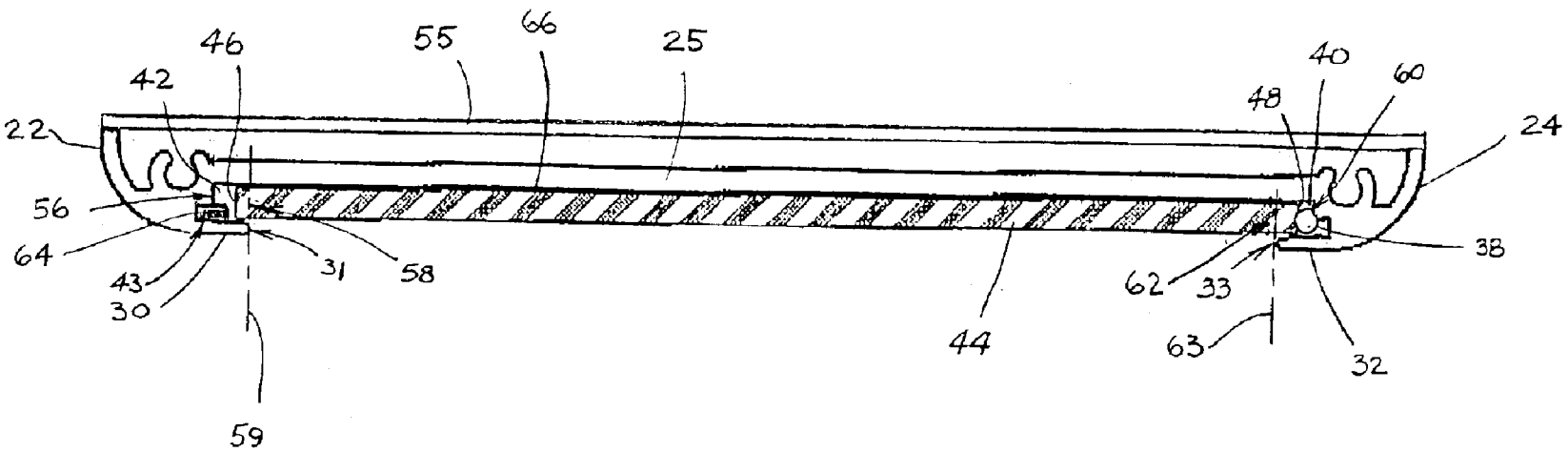
FIG. 2 is a partial sectional top view of the preferred embodiment of the sign assembly shown in FIG. 1.

As shown in FIGS. 1 and 2, first side frame portion 22 includes first flange 30 having first flange distal end 31. First recess 42 is defined, in part, by first flange 30. First recess includes bottom 56 and top 58. Top 58 of the first recess is defined by plane 59 extending from the first flange distal end toward the back plate in a direction generally perpendicular to the front panel. Second side frame portion 24 includes second flange 32 having second flange distal end 33. Second recess 40 is defined, in part, by second flange 32. Second recess 40 includes bottom 60 and top 62. Top 62 of the second recess is defined by plane 63 extending from the second flange distal end toward the back plate in a direction generally perpendicular to the front panel. In a preferred embodiment, a retaining recess 43 that comprises a portion of first recess 42 is adapted to receive filler 64. In a still further preferred embodiment, filler 64 is a plastomeric material adapted to urge front panel 44 toward the bottom of second recess 40.

Still referring to FIG. 1, the preferred sign assembly 20 also includes third side frame portion 26 and fourth side frame portion 28. The third side frame portion is disposed generally opposite the fourth side frame portion. In a preferred embodiment, the third and fourth side frame portions are provided with an adhesive material such as tape 29 in order to secure them to support surface 21. As shown in FIG. 1, front panel 44 has first side 46, second side 48 disposed generally opposite the first side, third side 50 and fourth side 52 disposed generally opposite the third side. As explained more fully below, the distance between the first side and the second side of the front panel is no greater than the distance between the bottom of the first recess and the top of the second recess. Also discussed more fully below, the distance between the third side and the fourth side of the front panel is no greater than the distance between the third side frame portion and the fourth side frame portion. In a preferred embodiment of the sign assembly of the invention, the front panel is transparent or translucent.

Still referring to FIG. 1, locking pin 36 is adapted to extend into and generally align with second recess 40 in second side frame portion 24. More particularly, the locking pin is adapted to extend into the second recess such that the locking pin and the front panel are substantially coplanar. In addition, the locking pin of the present invention may be inserted into and removed from the sign assembly at a location on the periphery of the assembly. Consequently, the locking pin of the present invention may be inserted and removed while the sign assembly is mounted to a wall or the like. In other words, the locking pin of the present invention may be inserted into and removed from the sign assembly without removing the sign assembly from a mounted position on a wall or the like. In a preferred embodiment, the locking pin includes head 38 that is larger than shaft 39. In another preferred embodiment, the locking pin is made of a ferromagnetic material and the second side frame portion is made from a material other than a ferromagnetic material. Also in a preferred embodiment, the sign assembly includes magnet 502 which is adapted to magnetically attract the locking pin to facilitate its removal from the second recess. See FIG. 10.

As shown in FIGS. 1 and 2, the first side frame portion, the second side frame portion, the third side frame portion, the fourth side frame portion, the front panel and the locking pin are arranged so that when second side 48 of the front panel is in second recess 40 and the locking pin is in the second recess, first side 46 of the front panel extends into first recess 42. In addition, when the locking pin is not in second recess 40, the front panel may be moved so that second side 48 of the front panel is disposed toward bottom 60 of second recess 40, and first side 46 of the front panel is disposed out of first recess 42 so that the front panel may be pivoted about second recess 40 in order to remove the front panel from the sign assembly. See also FIGS. 10–13. As described more fully below, in a preferred embodiment, the present invention includes a pulling tool such as suction cup 504 that is adapted to engage the front panel to facilitate the removal of the front panel from the sign assembly. See FIGS. 11–13.

Referring again to FIG. 1, in a preferred embodiment of the invention, sign assembly 20 includes a plurality of end caps 70. Each end cap is adapted to be secured to the first side frame portion and/or the second side frame portion. Also in this preferred embodiment, at least one of the end caps includes hole 34 generally aligned with second recess 40 and adapted to receive locking pin 36. It is also preferred that end cap 70 including hole 34 is chamfered so as to receive head 38 of the locking pin.

Referring now to FIG. 2, a partial sectional top view of the preferred embodiment of the sign assembly shown in FIG. 1 is illustrated. As shown in FIG. 2, preferred sign assembly 20 includes back plate 25 extending between first side frame portion 22 and second side frame portion 24 behind front panel 44. While not shown in FIG. 2, it is understood that the preferred back plate 25 also extends between third side frame portion 26 and fourth side frame portion 28. Back plate 25 is generally parallel to front panel 44 (or an insert placed between the front panel and the back plate). Back plate 25 may be made from any suitable material adapted to provide structural support to the side frame portions and the front panel (and any insert placed between the front panel and the back plate). In a preferred embodiment, sign assembly 20 also includes rear panel 55 which extends between and is attached to the side frame portions to provide structural stability to the sign frame and facilitate the mounting of the assembly to a wall or other structure.

As shown in FIG. 2, first side frame portion 22 includes first recess 42 which is defined, in part, by first flange 30 having first flange distal end 31. First recess 42 is adapted to receive first side 46 of front panel 44. First recess 42 has bottom 56 which is defined by the first side frame portion and top 58 which is defined by the plane extending from first flange distal end 31 toward back plate 25 in a direction generally perpendicular to front panel 44. Similarly, second side frame portion 24 includes second recess 40 which is defined, in part, by second flange 32 having second flange distal end 33. Second recess 40 is adapted to receive second side 48 of front panel 44. Second recess 40 has bottom 60 which is defined by the second side frame portion and top 62 which is defined by plane 63 extending from second flange distal end 33 toward back plate 25 in a direction generally perpendicular to front panel 44.

Still referring to FIG. 2, in the preferred sign assembly 20, the locking pin having locking pin head 38 is adapted to extend into second recess 40 to bear against the front panel so that the front panel is retained by the sign frame. In this configuration, first side 46 of front panel 44 extends into first recess 42 in frame portion 22 and second side 48 of the front panel extends into second recess 40 in frame portion 24. Consequently, when the first side of the front panel is in the first recess, the second side of the front panel is in the second recess and the locking pin extends into the second recess, the front panel is securely retained on the sign frame.

Referring still to FIG. 2, the preferred sign assembly 20 also includes filler 64 in retaining recess 43 portion of first recess 42 of first side frame portion 22. Filler 64 may be made from any suitable plastomeric material adapted to provide a resilient force to the front panel to urge it in the direction of second recess 40 in the second side frame portion. Also in a preferred embodiment, sign assembly 20 is adapted to receive and retain sign insert 66 between front panel 44 and back plate 25. The preferred insert is a sheet of paper or a piece of cardboard containing the content intended to be displayed by the sign assembly. Further, the preferred insert is sized to extend to the side frame portions. It is contemplated within the scope of the invention, however, that the insert may be made from any suitable material and sized to any suitable dimensions such that it may be removed from and inserted into the sign assembly.

Figure 3:
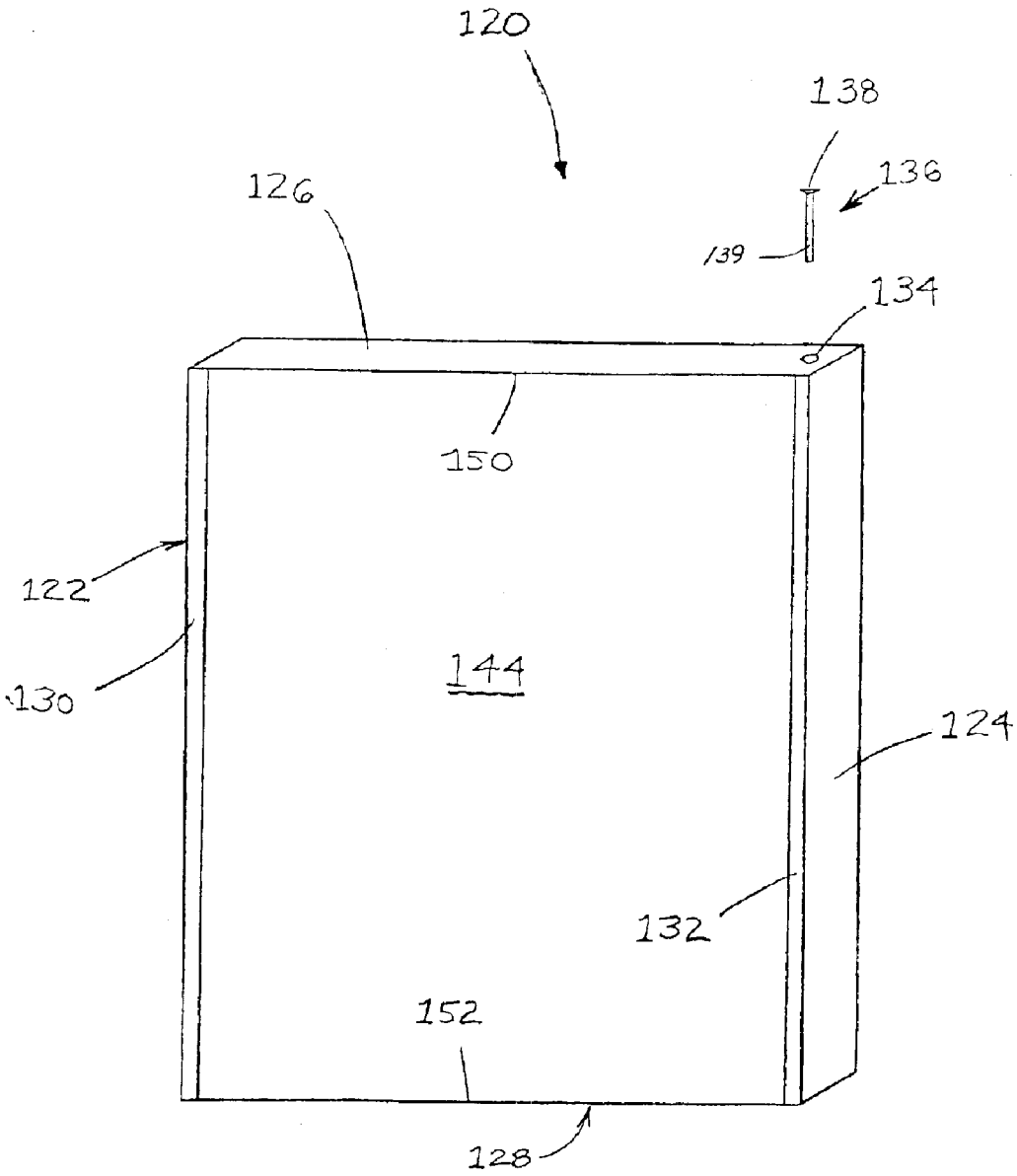
FIG. 3 is a perspective view of a first alternative embodiment of the sign assembly in accordance with the present invention.

Referring now to FIG. 3, a first alternative embodiment of the sign assembly according to the present invention is illustrated. As shown in FIG. 3, sign assembly 120 includes first side frame portion 122, second side frame portion 124 opposite the first side frame portion, third side frame portion 126 and fourth side frame portion 128 (See also FIGS. 12 and 13) opposite the third side frame portion. As illustrated in FIG. 3, first side frame portion 122, second side frame portion 124, third side frame portion 126 and fourth side frame portion 128 are arranged and connected to each other so as to form a generally rectangular sign frame.

It is contemplated within the scope of the invention that the sign assembly in accordance with the present invention may be mounted on any suitable generally vertical surface such as a wall or a door or any suitable generally horizontal surface such as a ceiling or a floor. It is further contemplated that the sign assembly of the present invention may be mounted to an inclined, declined, arcuate or irregular surface, and it may be supported by any suitable means such as one or more pedestals, posts or the like. It is still further contemplated within the scope of the invention that the sign assembly claimed herein may be mounted to a supporting structure by affixing one or more of the side frame portions directly to the supporting structure.

Referring still to FIG. 3, first side frame portion 122 includes first flange 130 and second side frame portion 124 includes second flange 132. As shown in FIGS. 4 through 9 and discussed in more detail below, first flange 130 defines, in part, a first recess in first side frame portion 122, and second flange 132 defines, in part, a second recess in the second side frame portion. While flanges 130 and 132 illustrated in FIG. 3 extend the entire length of the first and second side frame portions, respectively, it is contemplated within the scope of the invention that the flanges may extend for less than the entire length of the first and second side frame portions. It is also contemplated that each of the first and second side frame portions may include a plurality of shorter, separate flanges along its length. As also shown in FIG. 3, third side frame portion 126 includes hole 134, which is adapted to receive locking pin 136 having locking pin head 138 and shaft 139. Locking pin 136 is adapted to move into and out of hole 134 and removably extend into second recess 140 (See FIGS. 4 and 5) in the second side frame portion. The preferred hole is chamfered so as to receive head 138 of the locking pin. Furthermore, preferred locking pin 136 has a flat head which fits flush with the surface of the frame side portion through which it is inserted. The head of the preferred locking pin prevents the pin from moving into the interior of the sign assembly. The locking pin may be made of any material suitable for this purpose; however, in a preferred embodiment, the locking pin is ferromagnetic so that it may be easily removed from the sign assembly using a magnet. Although the locking pin is described and shown herein as a generally cylindrical pin, it may be a threaded fastener or any other suitable device adapted to be removably inserted into the sign assembly to bear against the front panel.

Figure 4:
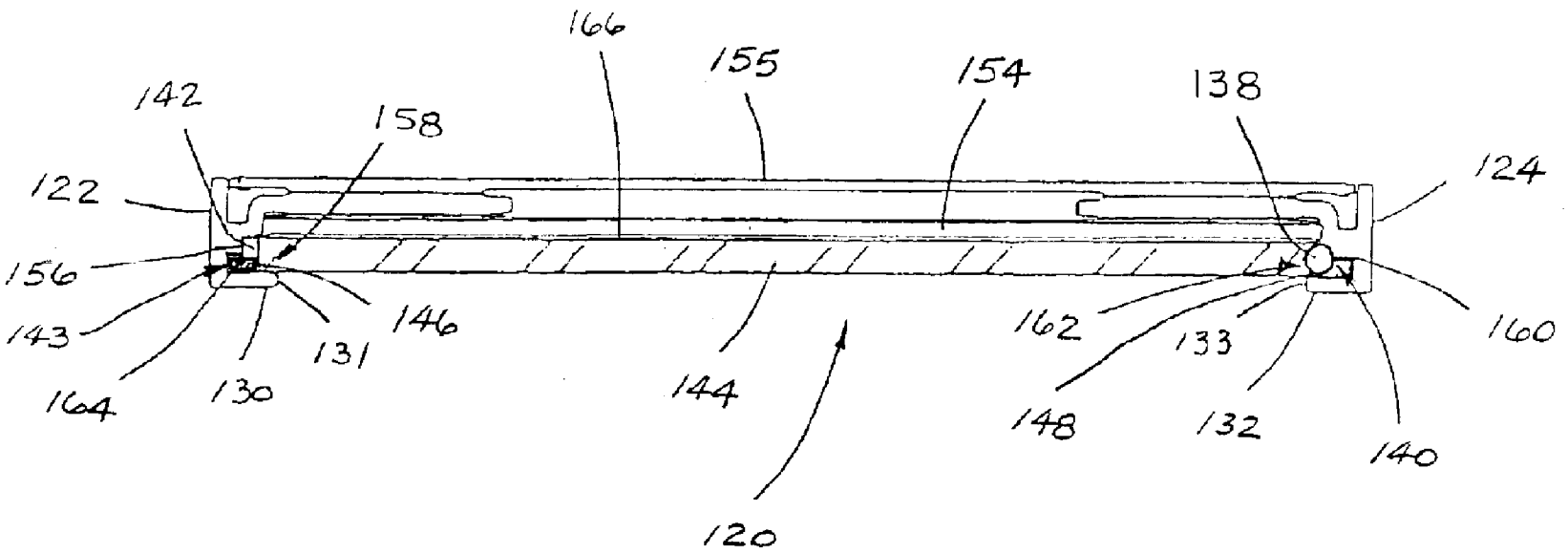
FIG. 4 is a partial sectional top view of the alternative embodiment of the sign assembly shown in FIG. 3.

Referring to FIGS. 3 and 4, preferred sign assembly 120 also includes front panel 144 which is generally rectangular and includes first side 146 (See FIG. 4), second side 148 (See FIG. 4) opposite the first side, third side 150 and fourth side 152 opposite the third side. Also in the preferred embodiment, the front panel is sized such that second side 148 extends into second recess 140 in second side frame portion 124 and first side 146 extends into first recess 142 in first side frame portion 122 (See FIG. 4). Also in the preferred embodiment, third side 150 and fourth side 152 of the front panel are sized to extend to third side frame portion 126 and fourth side frame portion 128 (See FIGS. 12 and 13), respectively. Front panel 144 may be made from any suitable material such as glass, an acrylic material or other plastic material. In a preferred embodiment, front panel 144 is made from a transparent material or a translucent material that permits a sign insert that is located behind or contained within the front panel to be observed through the front panel. The front panel of the preferred embodiment is generally planar. It is contemplated within the scope of the invention, however, that the front panel may have other surface configurations. In addition, the front panel may itself contain or display information and/or graphics.

Referring now to FIG. 4, a partial sectional top view of the preferred embodiment of the sign assembly shown in FIG. 3 is illustrated. As shown in FIG. 4, preferred sign assembly 120 includes back plate 154 extending between first side frame portion 122 and second side frame portion 124 behind front panel 144. While not shown in FIG. 4, it is understood that the preferred back plate 154 also extends between third side frame portion 126 and fourth side frame portion 128. Back plate 154 is generally parallel to front panel 144 (or an insert placed between the front panel and the back plate). Back plate 154 may be made from any suitable material adapted to provide structural support to the side frame and the front panel (and any insert placed between the front panel and the back plate). In a preferred embodiment, sign assembly 120 also includes rear panel 155 which extends between and is attached to the side frame portions to provide structural stability to the sign frame and facilitate the mounting of the assembly to a wall or other structure.

As shown in FIG. 4, first side frame portion 122 includes first recess 142 which is defined, in part, by first flange 130 having first flange distal end 131. First recess 142 is adapted to receive first side 146 of front panel 144. First recess 142 has bottom 156 which is defined by the first side frame portion and top 158 which is defined by the plane extending from first flange distal end 131 toward back plate 154 in a direction generally perpendicular to front panel 144. Similarly, second side frame portion 124 includes second recess 140 which is defined, in part, by second flange 132 having second flange distal end 133 (See also FIG. 5). Second recess 140 is adapted to receive second side 148 of front panel 144. Second recess 140 has bottom 160 which is defined by the second side frame portion and top 162 which is defined by plane 163 (See FIG. 5) extending from second flange distal end 133 toward back plate 154 in a direction generally perpendicular to front panel 144.

Still referring to FIG. 4, in the preferred sign assembly 120, the locking pin having locking pin head 138 and shaft 139 is adapted to extend into second recess 140 (See also FIG. 5) to bear against the front panel so that the front panel is retained by the sign frame. In this configuration, first side 146 of front panel 144 extends into first recess 142 in frame portion 122 and second side 148 of the front panel extends into second recess 140 in frame portion 124. Consequently, when the first side of the front panel is in the first recess, the second side of the front panel is in the second recess and the locking pin extends into the second recess, the front panel is securely retained on the sign frame.

Referring still to FIG. 4, the preferred sign assembly 120 also includes filler 164 in retaining recess 143 of first recess 142 of first side frame portion 122. Filler 164 may be made from any suitable plastomeric material adapted to provide a resilient force to the front panel to urge it in the direction of second recess 140 in the second side frame portion. Also in a preferred embodiment, sign assembly 120 is adapted to receive and retain sign insert 166 between front panel 144 and back plate 154. The preferred insert is a sheet of paper or a piece of cardboard containing the content intended to be displayed by the sign assembly. Further, the preferred insert is sized to extend to the side frame portions. It is contemplated within the scope of the invention, however, that the insert may be made from any suitable material and sized to any suitable dimensions such that it may be removed from and inserted into the sign assembly.

Figure 5:
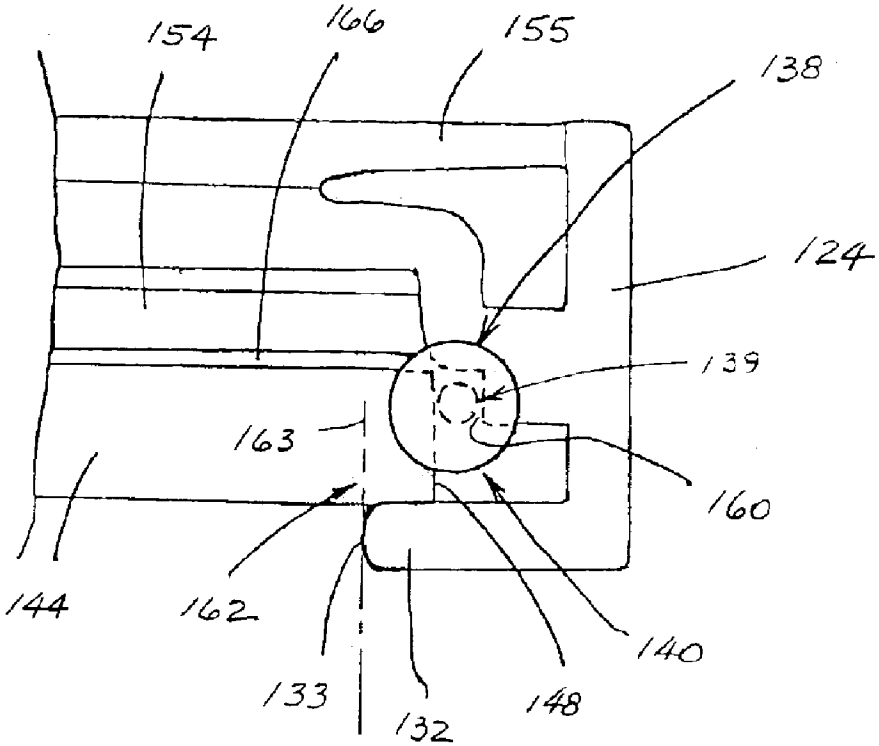
FIG. 5 is an enlarged partial sectional top view of the right side of the sign assembly shown in FIGS. 3 and 4.

Referring now to FIG. 5, an enlarged partial sectional top view of the second side frame portion of the preferred sign assembly shown in FIGS. 3 and 4 is illustrated. As shown in FIG. 35 the locking pin having locking pin head 138 and shaft 139 is adapted to extend into second recess 140 and prevent second side 148 of front panel 144 from bearing against bottom 160. When the locking pin extends into second recess 140, second flange distal end 133 extends beyond second side 148 of front panel 144 so as to retain the front panel on the sign frame. More particularly, when the locking pin is inserted into the second recess, the second side of the front panel extends into the second recess past the top of the second recess which is defined by plane 163. It can be appreciated from FIG. 5 that when locking pin 136 is removed from second recess 140, second side 148 of front panel 144 may be moved toward bottom 160 of second recess 140 (See also FIG. 6). Back plate 154 provides support to front panel 144 and insert 166. Rear panel 155 provides structural stability to the sign frame and facilitates the mounting of the sign assembly to a wall or the like.

Figure 6:
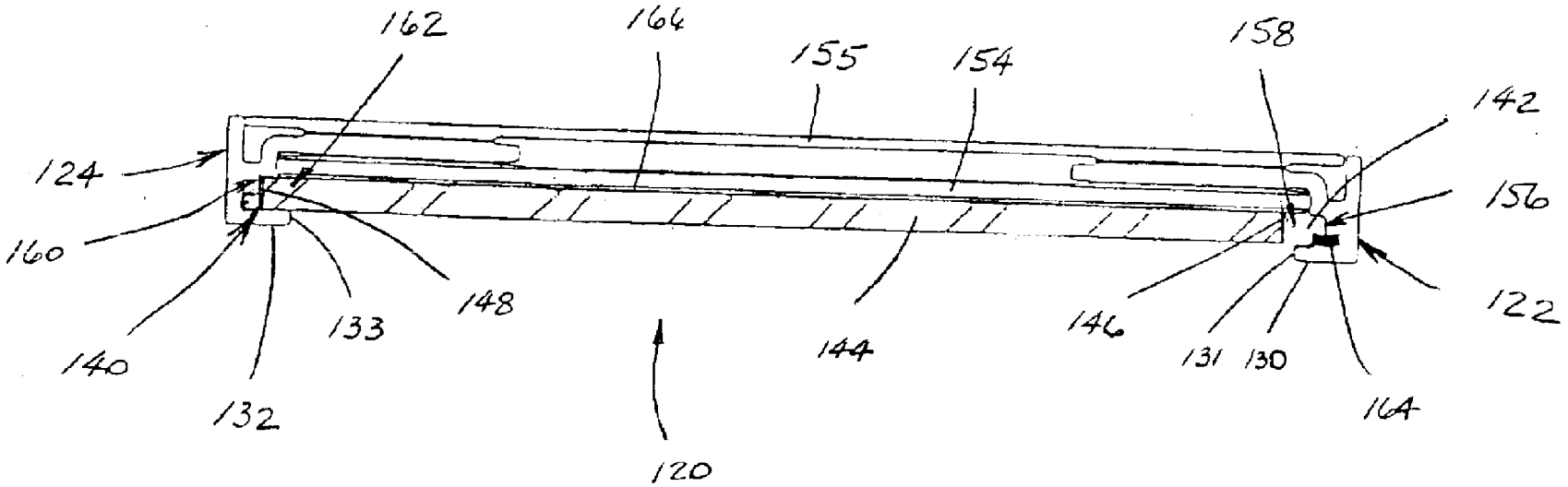
FIG. 6 is a partial sectional top view of the preferred embodiment of the sign assembly shown in FIGS. 3 through 5 illustrating the sign assembly with the locking pin removed, and the front panel moved so that its second side is toward the bottom of the second recess in the second side frame portion and its first side is out of the first recess in the first side frame portion.

Referring now to FIG. 6, a partial sectional top view of the preferred embodiment of the sign assembly shown in FIGS. 3 through 5 is illustrated. More particularly, FIG. 6 shows preferred sign assembly 120 with the locking pin removed from the assembly and front panel 144 moved so that second side 148 is toward bottom 160 of recess 140 in second side frame portion 124. When the second side of the front panel bears against the bottom of the second recess in the second side frame portion, first side 146 of front panel 144 no longer extends into first recess 142 in first side frame portion 122. With the first side of the front panel no longer extending into the first recess in the first side frame portion, a pulling force may be applied to the front panel causing the front panel to pivot about the second recess in the second side frame portion, as more fully discussed below.

Figure 7:
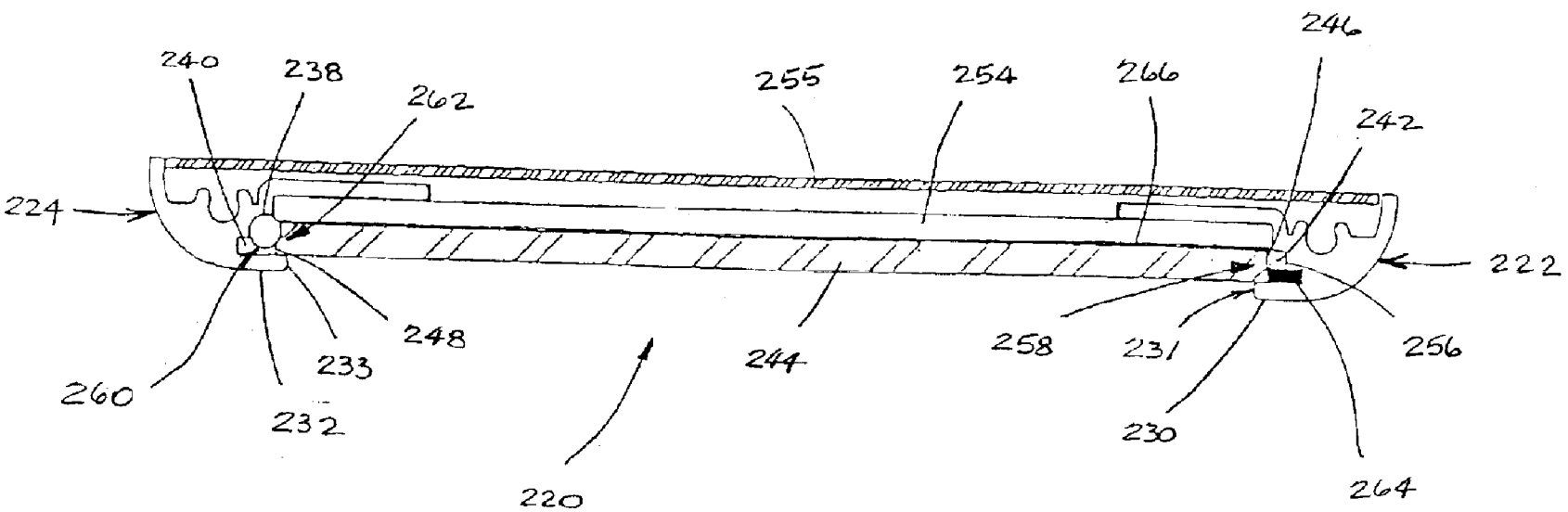
FIG. 7 is a partial sectional top view of a second alternative embodiment of the sign assembly in accordance with the present invention.

Referring now to FIG. 7, a partial sectional top view of a second alternative embodiment of the sign assembly in accordance with the present invention is illustrated. More particularly, preferred sign assembly 220 includes first side frame portion 222 and second side frame portion 224 which are configured so as to form an arcuate-appearing sign frame. A third side frame portion (not shown) that is similar to third side frame portion 126 of assembly 120 and a fourth side frame portion (also not shown) that is similar to fourth side frame portion 128 of assembly 120 are contemplated to complete the frame of sign assembly 220. First side frame portion 222 includes first flange 230 having first flange distal end 231. First flange 230 defines, in part, first recess 242. First recess 242 is adapted to receive first side 246 of front panel 244. First recess 242 includes bottom 256 which is defined by first side frame portion 222 and top 258 which is defined by the plane that extends from first flange distal end 231 toward back plate 254 in a generally perpendicular direction relative to the back plate. Second side frame portion 224 includes second flange 232 having second flange distal end 233. Second flange 232 defines, in part, second recess 240. Second recess 240 is adapted to receive second side 248 of front panel 244. In addition, second recess 240 is adapted to receive a locking pin having locking pin head 238. Second recess 240 includes bottom 260 which is defined by second side frame portion 224 (similar to the way that bottom 160 of assembly 120 is defined by second side frame portion 124, as best shown in FIG. 5) and top 262 which is defined by the plane that extends from second flange distal end 233 toward back plate 254 in a generally perpendicular direction relative to the back plate.

Still referring to FIG. 7, back plate 254 extends between first side frame portion 222 and second side frame portion 124. While not illustrated, it is understood that preferred back plate 254 also extends between the third side frame portion (not shown) and the fourth side frame portion (not shown) so as to provide structural stability to the sign frame and a surface against which the front panel, and preferably insert 266, may bear. In a preferred embodiment, filler 264 is provided in a portion of first recess 242 so as to exert a resilient force against first side 246 of front panel 244 in a direction toward second recess 240. Also in a preferred embodiment, rear panel 255 extends between and is attached to the four side frame portions so as to provide structural stability to the sign frame and facilitate the mounting of the sign assembly on a wall or other structure.

Figure 8:
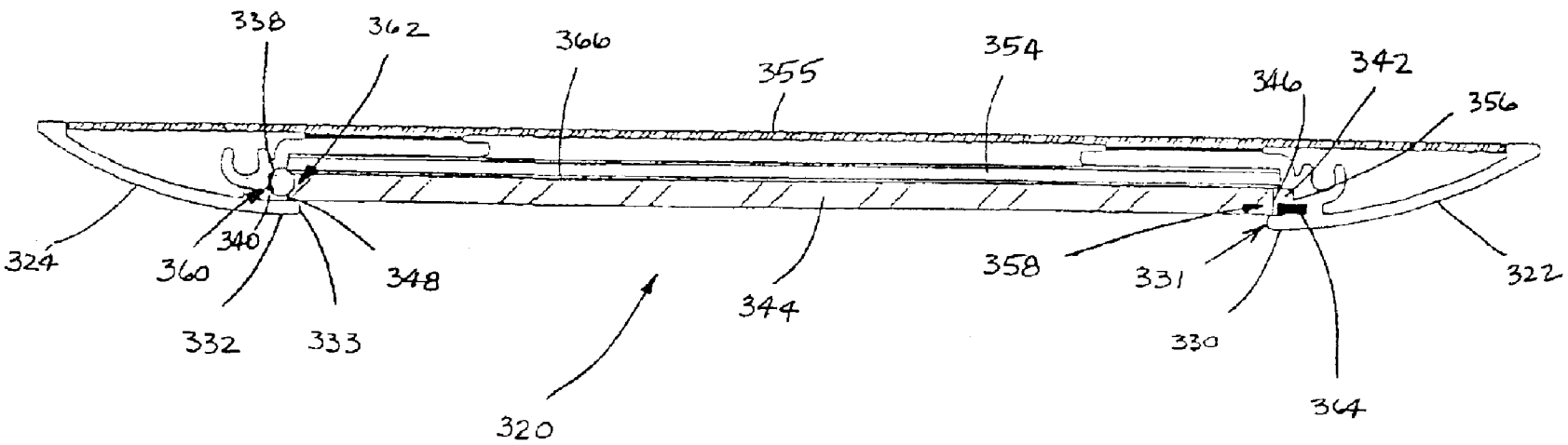
FIG. 8 is a partial sectional top view of a third alternative embodiment of the sign assembly in accordance with the present invention.

Referring now to FIG. 8, a partial sectional top view of a third alternative embodiment of the sign assembly in accordance with the present invention is illustrated. More particularly, preferred sign assembly 320 includes first side frame portion 232 and second side frame portion 324 which are configured so as to form a contoured-appearing sign frame. A third side frame portion (not shown) that is similar to third side frame portion 26 of assembly 20 and a fourth side frame portion (also not shown) that is similar to fourth side frame portion 28 of assembly 20 are contemplated to complete the frame of sign assembly 320. First side frame portion 322 includes first flange 330 having first flange distal end 331. First flange 330 defines, in part, first recess 342. First recess 342 is adapted to receive first side 346 of front panel 344. First recess 342 includes bottom 356 which is defined by first side frame portion 322 and top 358 which is defined by the plane that extends from first flange distal end 331 toward back plate 354 in a generally perpendicular direction relative to the back plate. Second side frame portion 324 includes second flange 332 having second flange distal end 333. Second flange 332 defines, in part, second recess 340. Second recess 340 is adapted to receive second side 348 of front panel 344. In addition, second recess 340 is adapted to receive a locking pin having locking pin head 338. Second recess 340 includes bottom 360 which is defined by second side frame portion 324 (similar to the way that bottom 160 of assembly 120 is defined by second side frame portion 124, as best shown in FIG. 5) and top 362 which is defined by the plane that extends from second flange distal end 333 toward back plate 354 in a generally perpendicular direction relative to the back plate.

Still referring to FIG. 8, back plate 354 extends between first side frame portion 322 and second side frame portion 324. While not illustrated, it is understood that back plate 354 also extends between the third side frame portion (not shown) and the fourth side frame portion (not shown) so as to provide structural stability to the sign frame and a surface against which the front panel, and preferably insert 366, may bear. In the preferred embodiment of FIG. 8, filler 364 is provided in a portion of first recess 342 so as to exert a resilient force against first side 346 of front panel 344 in a direction toward second recess 340. Also in a this embodiment, rear panel 355 extends between and is attached to the four side frame portions so as to provide structural stability to the sign frame and facilitate the mounting of the sign assembly on a wall or other structure.

Figure 9:
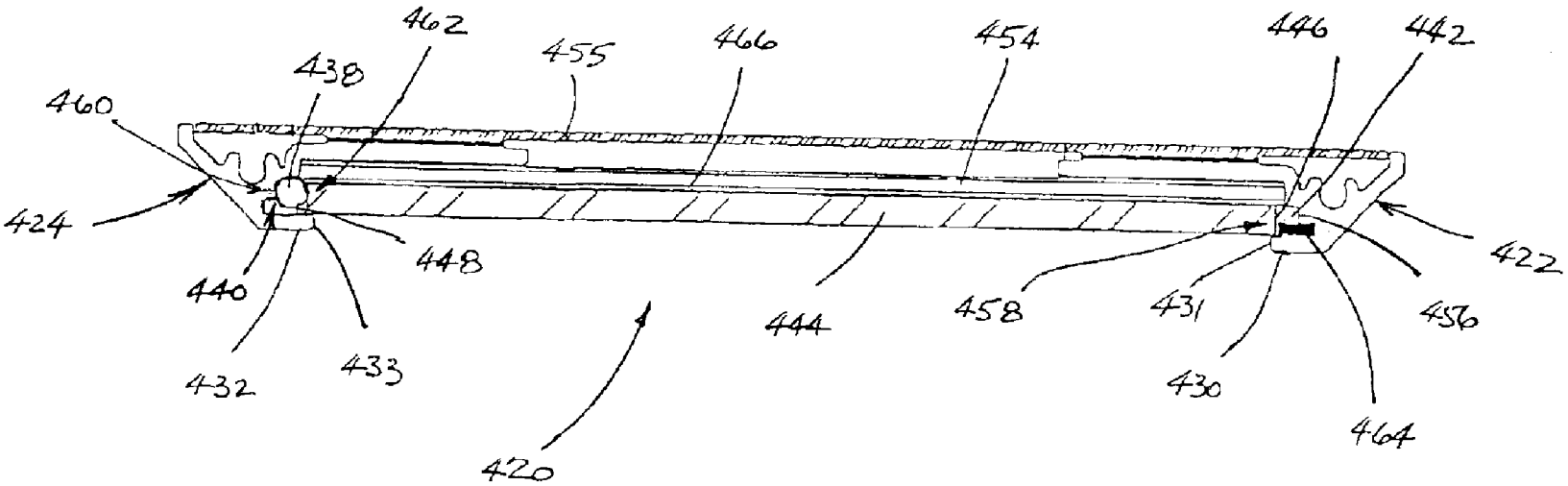
FIG. 9 is a partial sectional top view of a fourth alternative embodiment of the sign assembly in accordance with the present invention.

Referring now to FIG. 9, a partial sectional top view of a fourth alternative embodiment of the sign assembly in accordance with the present invention is illustrated. More particularly, preferred sign assembly 420 includes first side frame portion 422 and second side frame portion 424 which are configured so as to form a beveled-appearing sign frame. A third side frame portion (not shown) that is similar to third side frame portion 26 of assembly 20 and a fourth side frame portion (also not shown) that is similar to fourth side frame portion 28 of assembly 20 are contemplated to complete the frame of sign assembly 420. First side frame portion 422 includes first flange 430 having first flange distal end 431. First flange 430 defines, in part, first recess 442. First recess 442 is adapted to receive first side 446 of front panel 444. First recess 442 includes bottom 456 which is defined by first side frame portion 422 and top 458 which is defined by the plane that extends from first flange distal end 431 toward back plate 454 in a generally perpendicular direction relative to the back plate. Second side frame portion 424 includes second flange 432 having second flange distal end 433. Second flange 432 defines, in part, second recess 440. Second recess 440 is adapted to receive second side 448 of front panel 444. In addition, second recess 440 is adapted to receive a locking pin having locking pin head 438. Second recess 440 includes bottom 460 which is defined by second side frame portion 424 (similar to the way that bottom 160 of assembly 120 is defined by second side frame portion 124, as best shown in FIG. 5) and top 462 which is defined by the plane that extends from second flange distal end 433 toward back plate 454 in a generally perpendicular direction relative to the back plate.

Still referring to FIG. 9 back plate 454 extends between first side frame portion 422 and second side frame portion 424. While not illustrated, it is understood that back plate 454 also extends between the third side frame portion (not shown) and the fourth side frame portion (not shown) so as to provide structural stability to the sign frame and a surface against which the front panel, and preferably insert 466, may bear. In the embodiment of FIG. 9, filler 464 is provided in a portion of first recess 442 so as to exert a resilient force against first side 446 of front panel 444 in a direction toward second recess 440. Also in this embodiment, rear panel 455 extends between and is attached to the four side frame portions so as to provide structural stability to the sign frame and facilitate the mounting of the sign assembly on a wall or other structure.

Figure 10:
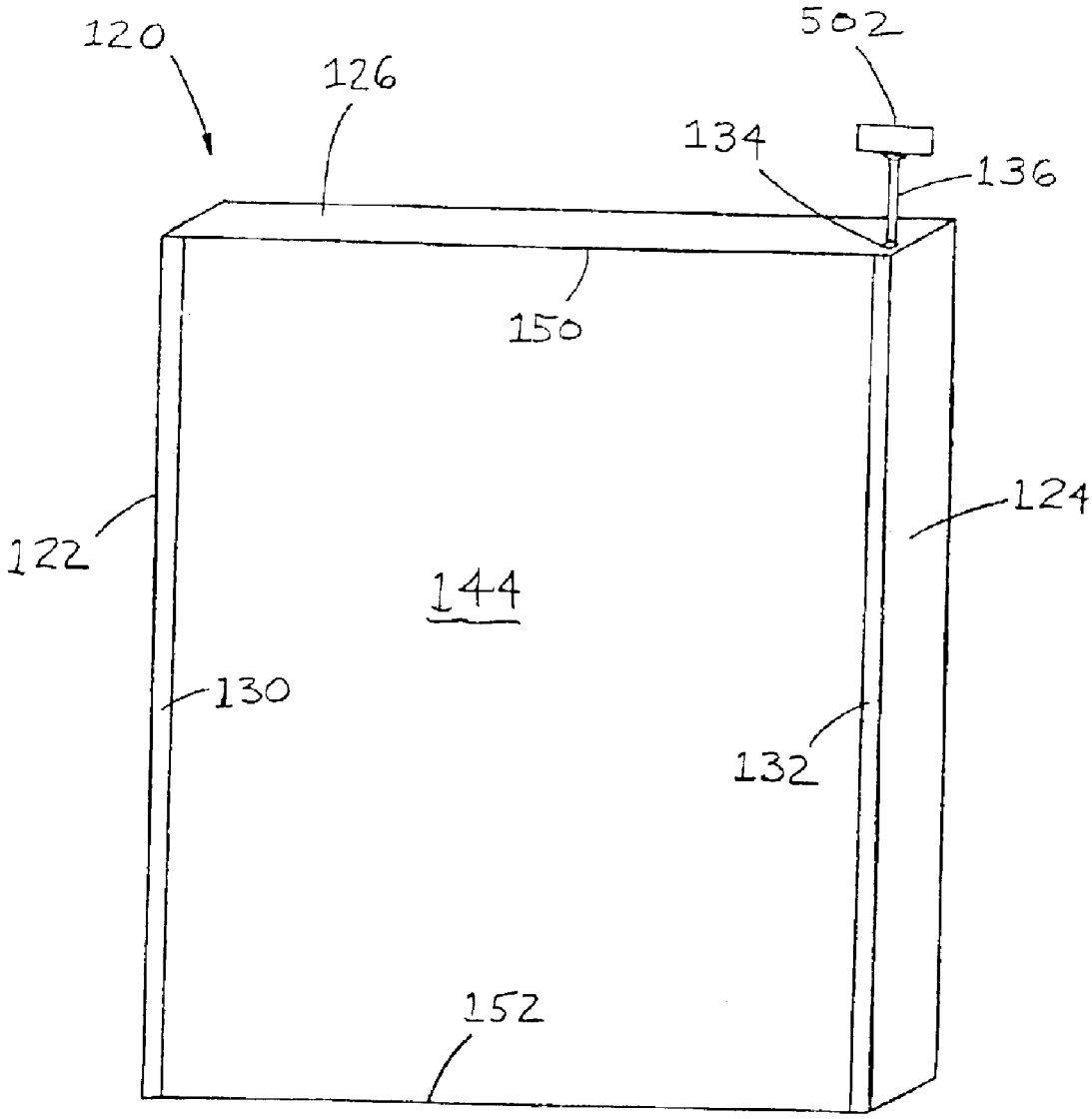
FIG. 10 is a perspective view of the preferred embodiment of the sign assembly shown in FIGS. 3 through 6 illustrating the removal of the locking pin from the sign assembly using a magnet.
Figure 11:
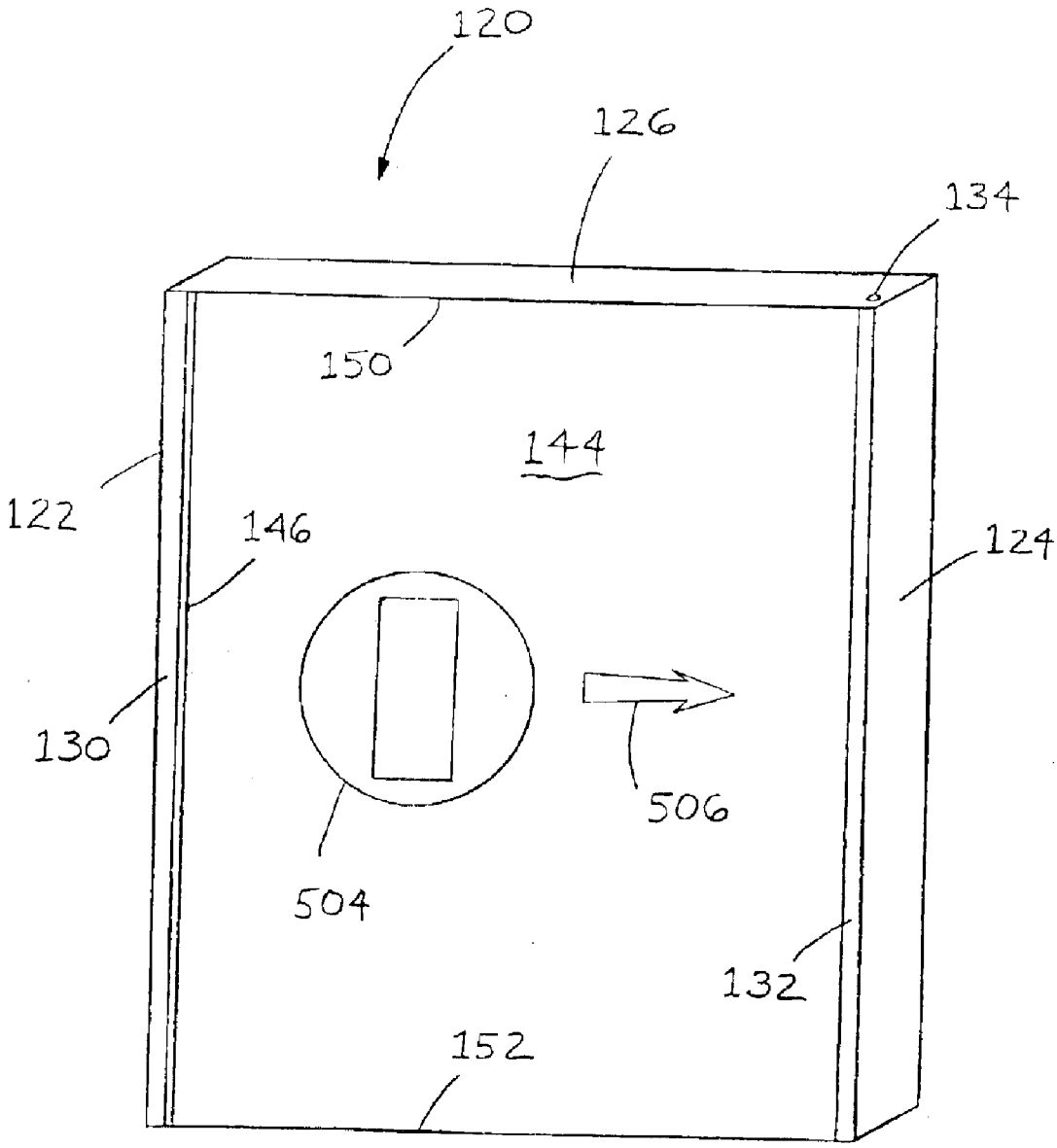
FIG. 11 is a perspective view of the preferred embodiment of the sign assembly shown in FIGS. 3 through 6 and 10 illustrating the application of a suction cup tool to the front panel and the movement of the front panel in the direction so that its second side is toward the bottom of the second recess in the second side frame portion.

In operation, several advantages of the invention are achieved. FIGS. 10 through 13 illustrate the removal of the front panel from preferred sign assembly 20. As shown in FIG. 10, in the preferred embodiment of sign assembly 120, magnet 502 is used to remove locking pin 136 from hole 134 in third side frame portion 126. Referring now to FIG. 11, after locking pin 136 is removed from preferred sign assembly 120, suction cup 504 is pressed against front panel 144 so that the suction cup engages with the front panel. As shown in FIG. 11, the front panel may then be moved in the direction toward bottom 160 of second recess 140 of second side frame portion 124 as indicated by arrow 506 (See also FIG. 6). When second side 148 of front panel 144 is moved to the bottom of second recess 140, first side 146 of front panel 144 does not extend into first recess 142 of first side frame portion 122 (See also FIG. 6).

Figure 12:
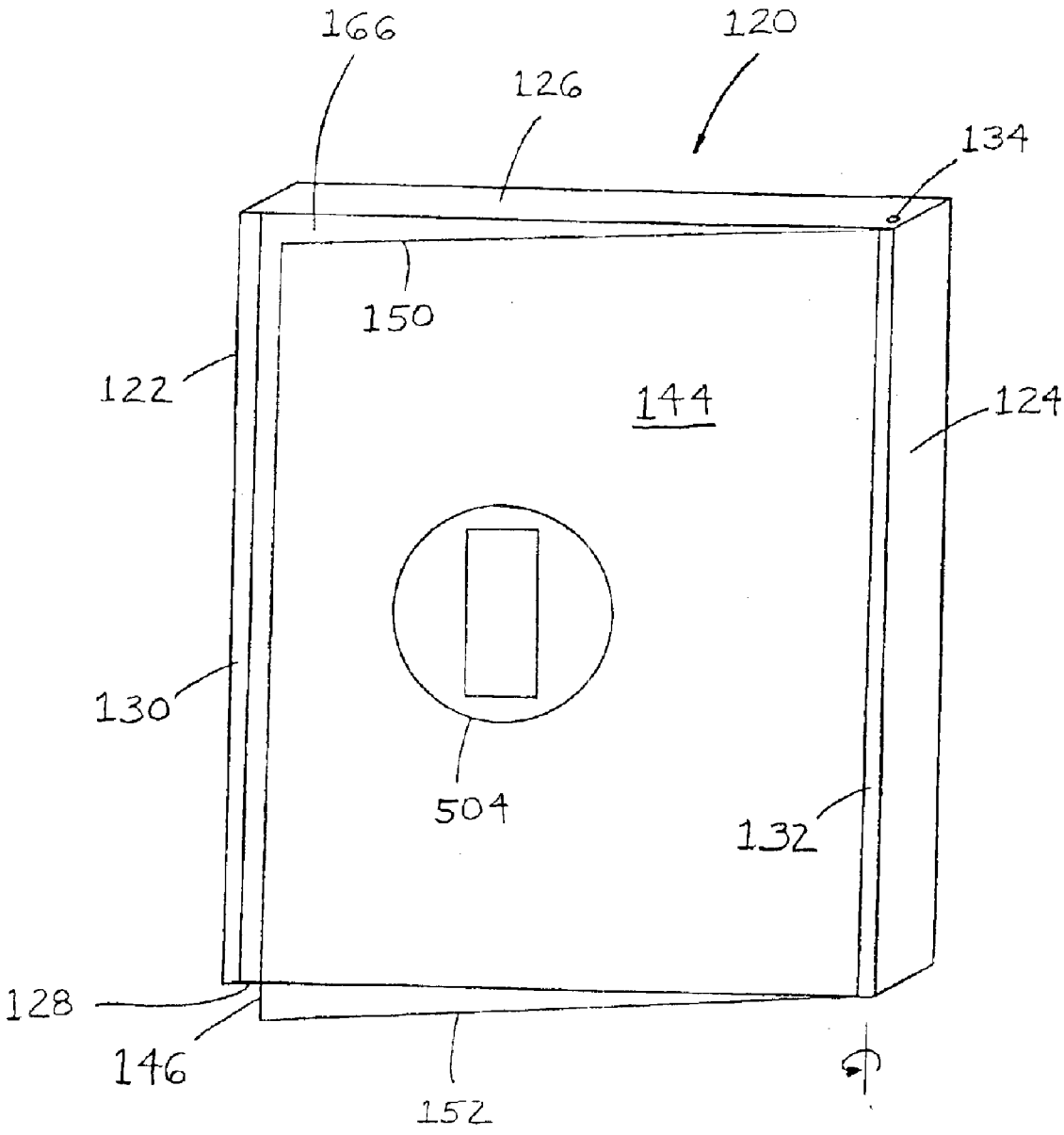
FIG. 12 is a perspective view of the preferred embodiment of the sign assembly shown in FIGS. 3 through 6 and 10 through 11 illustrating the pivoting of the front panel about the second recess in the second side frame portion.
Figure 13:
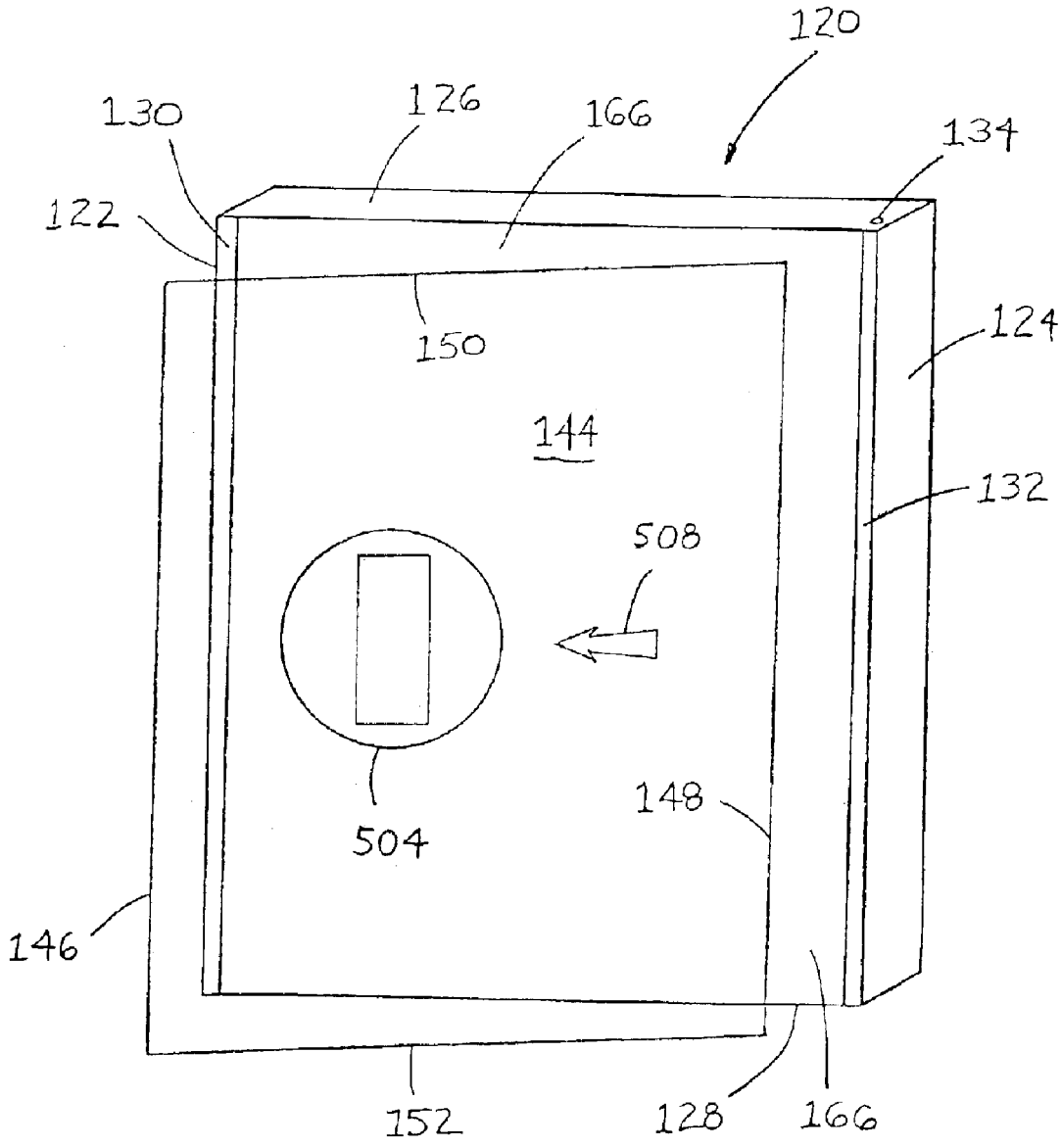
FIG. 13 is a perspective view of the preferred embodiment of the sign assembly shown in FIGS. 3 through 6 and 10 through 12 illustrating the movement of the front panel in the direction away from the second recess in the second side frame portion in order to remove the front panel from the assembly.

With second side 148 of front panel 144 bearing against bottom 160 of second recess 140 and first side 146 of front panel 144 no longer extending into first recess 142, a pulling force may be applied to the suction cup so as to pivot the front panel about second recess 140 as shown in FIG. 12. Referring now to FIG. 13, the second side of the front panel may then be moved in the direction indicated by arrow 508 in order to remove second side 148 of the front panel from the second recess. With the front panel removed from the sign assembly, insert 166 may be removed and replaced or a different front panel may be used to replace the removed front panel. In order to replace a front panel and insert, the foregoing steps may be performed in reverse order.

While FIGS. 10 through 13 illustrate hole 134 in the horizontally-disposed top side frame portion such that locking pin 136 is disposed in a generally vertical condition, it is contemplated within the scope of the invention that the hole may be located in the horizontally-disposed bottom side frame portion or in either of the vertically-disposed lateral side frame portions such that the locking pin is disposed in a generally horizontal position. Similarly, end plates 70 may be located on the horizontally-disposed side frame members such that the locking pin is disposed in a generally horizontal position. Finally, it is contemplated that the locking pin may simply extend into the recess of a horizontally-disposed side frame portion such that the locking pin is disposed in a generally horizontal position. This aspect of the invention is particularly advantageous when the sign assembly is mounted in a location where one or more objects such as a door frame may obstruct access to one or more side frame portions. It is further understood that although FIGS. 10 through 13 illustrate a ferromagnetic locking pin that is removed using a magnet, the locking pin may be non-ferromagnetic and removed from the sign assembly using any suitable means such as a screwdriver, Allen wrench, socket wrench or the like. In addition, although FIGS. 11 through 13 illustrate a suction cup for removing the front panel from the sign frame, any suitable device may be used to remove the front panel from the sign frame.

As noted above, in a preferred embodiment of the sign assembly, a plastomeric filler is provided in a portion of the recess of a side frame portion. The purpose of the plastomeric filler is to provide resilient force in the direction toward the recess of the side frame portion into which the locking pin extends and reduce the sliding movement of the front panel (and an insert) relative to the sign frame. In operation, when the front panel is inserted into the sign assembly behind the flanges of the side frame portions and the locking pin extends into the recess of the side frame portion opposite the recess including the plastomeric filler, the plastomeric filler urges the front panel in the direction of, and preferably to bear against, the locking pin. Consequently, sliding movement of the front panel and an insert relative to the sign frame is minimized or eliminated by the filler. When the locking pin is removed, the plastomeric filler exerts a resilient force that urges the front panel away from the bottom of the recess including the plastomeric filler and toward the bottom of the recess on the opposite side frame portion, i.e., the recess from which the locking pin was removed. This resilient force facilitates the removal of the front panel from the sign assembly as described above. While FIGS. 1, 4 and 6 through 9 illustrate the filler in a portion of the first recess of the first side frame portion, it is contemplated within the scope of the invention that the filler may be located on any side frame portion such that it is able to exert a resilient force on the panel in the direction of the recess into which the locking pin is inserted.

Although this description contains many specifics, these should not be construed as limiting the scope of the invention but as merely providing illustration of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A sign assembly comprising:

(A) a support surface including:

(i) a first side frame portion having a longitudinal first recess along the length thereof, said first recess having a bottom and a top; and (ii) a second side frame portion having a longitudinal second recess along the length thereof, said second recess having a bottom and a top;

(iii) a back plate;

wherein the second side frame portion is disposed opposite the first side frame portion and the back plate is disposed between the first side frame portion and the second side frame portion;

(B) a third side frame portion;

(C) a fourth side frame portion;

wherein the third side frame portion is disposed generally opposite the fourth side frame portion;

(D) a front panel having:

(i) a first side;

(ii) a second side that is disposed generally opposite the first side;

(iii) a third side;

(iv) a fourth side that is disposed generally opposite the third side;

wherein the distance between the first side and the second side is no greater than the distance between the bottom of the first recess and the top of the second recess; and wherein the distance between the third side and the fourth side is no greater than the distance between the third side frame portion and the fourth side frame portion;

(E) a locking pin that is adapted to extend into and generally align with the second recess;

wherein the first side frame portion, the second side frame portion, the third side frame portion, the fourth side frame portion, the front panel and the locking pin are arranged so that:

(F) when the second side of the front panel is in the second recess and the locking pin is in the second recess, the first side of the front panel extends into the first recess;

(G) when the locking pin is not in the second recess, the front panel may be moved so that the second side of the front panel is disposed toward the bottom of the second recess and the first side of the front panel is disposed out of the first recess so that said panel may be pivoted about the second recess to remove the front panel from the sign assembly.

2. The apparatus of claim 1 wherein the first side frame portion is disposed generally parallel to the second side frame portion.

3. The apparatus of claim 1 which includes a pulling tool that is adapted to engage the front panel to facilitate the removal of the front panel from the sign assembly.

4. The apparatus of claim 1:

(A) wherein the locking pin is made of a ferromagnetic material; and (B) wherein the second side frame portion is made from a material other than a ferromagnetic material; and (C) which includes a magnet that is adapted to magnetically attract the locking pin to facilitate its removal from the second recess.

5. The apparatus of claim 1:

(A) wherein the locking pin includes a shaft and a head that is larger than the shaft; and (B) wherein the second recess is chamfered so as to receive the head of the locking pin.

6. The apparatus of claim 1 which includes a rear panel that is mounted to the sign assembly behind the support surface.

7. The apparatus of claim 1 wherein the front panel is transparent.

8. The apparatus of claim 1 wherein the front panel is translucent.

9. The apparatus of claim 1 which includes an insert that is removably placed between the front panel and the support surface.

10. The apparatus of claim 1 wherein the first side frame portion comprises a first flange having a first flange distal end, and wherein the top of the first recess is defined by a plane extending from the first flange distal end toward the back plate in a direction generally perpendicular to the front panel.

11. The apparatus of claim 1 wherein the second side frame portion comprises a second flange having a second flange distal end and wherein the top of the second recess is defined by a plane extending from the second flange distal end toward the back plate in a direction generally perpendicular to the front panel.

12. The apparatus of claim 1 wherein a filler is provided in a portion of the first recess so as to urge the second side of the front panel toward the bottom of the second recess.

13. The apparatus of claim 12 wherein the filler comprises a plastomeric material.

14. The apparatus of claim 1 wherein the third side frame portion and the fourth side frame portion include tape.

15. The apparatus of claim 1 further including a plurality of end caps adapted to be secured to the first side frame portion and the second side frame portion.

16. The apparatus of claim 15 wherein at least one of the end caps includes a hole generally aligned with the second recess and adapted to receive the locking pin.

17. The apparatus of claim 16 wherein:

(A) the locking pin includes a shaft and a head that is larger than the shaft; and (B) the hole in at least one of the end caps is chamfered so as to receive the head of the locking pin.

18. A sign assembly comprising:

(A) a generally rectangular back plate;

(B) a generally rectangular sign frame that is attached to and positioned in front of the back plate, which sign frame includes:

(i) a first side frame portion which includes a longitudinal first recess along the length thereof, said recess having a bottom and a top; and (ii) a second side frame portion which includes a longitudinal second recess along the length thereof, said recess having a bottom and a top;

wherein said first side frame portion and said second side frame portion are disposed on opposite sides of the sign frame with the first recess and the second recess facing and being parallel to each other;

(iii) a third side frame portion;

(iv) a fourth side frame portion;

wherein said third side frame portion and said fourth side frame portion are disposed on opposite sides of the sign frame; and wherein either the third side frame portion or the fourth side frame portion includes a hole that is generally aligned with the second recess;

(C) a generally rectangular front panel having:

(i) a first side; and (ii) a second side that is opposite the first side; and (iii) a third side; and (iv) a fourth side that is opposite the third side;

wherein the distance between the first side and the second side is no greater than the distance between the bottom of the first recess and the top of the second recess; and wherein the distance between the third side and the fourth side is no greater than the distance between the third side frame portion and the fourth side frame portion of the sign frame;

(D) a locking pin that is adapted to extend through the hole in either the third side frame portion or the fourth side frame portion and into the second recess;

wherein said first side frame portion, second side frame portion, third side frame portion, fourth side frame portion, front panel and locking pin are arranged so that:

(E) when the second side of the front panel is in the second recess and the locking pin is in the second recess, the first side of the front panel extends into the first recess;

(F) when the locking pin is not in the second recess, the front panel may be moved so that the second side of the front panel is toward the bottom of the second recess and the first side of the front panel is out of the first recess so that said panel may be pivoted about the second recess to remove the front panel from the sign frame.

19. The apparatus of claim 18:

(A) wherein the locking pin is made of a ferromagnetic material; and (B) wherein the side frame portion which includes the hole for the locking pin is made from a material other than a ferromagnetic material; and (C) which includes a magnet that is adapted to magnetically attract the locking pin to facilitate its removal from the hole.

20. The apparatus of claim 18:

(A) wherein the locking pin includes a shaft and a head that is larger than the shaft; and (B) wherein the hole for the locking pin through either the third side frame portion or the fourth side frame portion is chamfered so as to receive the head of the locking pin.

* * * * *